US005579546A

United States Patent [19]

Griskauskas

[11] Patent Number: 5,579,546

[45] Date of Patent: Dec. 3, 1996

[54] DEVICE FOR MOVING A DISABLED PERSON

[76] Inventor: Margaret Griskauskas, 39 John Dr., Farmingville, N.Y. 11738

[21] Appl. No.: 537,624

[22] Filed: Oct. 2, 1995

[51] Int. Cl.[6] ..... A61G 7/14; A61G 1/048

[52] U.S. Cl. ..... 5/81.1 T; 5/627

[58] Field of Search ..... 5/81.1 T, 81.1 R, 5/625, 627; 16/111 R, 114 R; 294/140, 26

[56] References Cited

U.S. PATENT DOCUMENTS

| | | | |
|---|---|---|---|
| D. 339,771 | 9/1993 | Newman | 5/81.1 |
| 555,681 | 3/1896 | Dalton | 294/26 |
| 867,886 | 10/1907 | Kriner | 294/26 |
| 2,835,902 | 5/1958 | Fash | 5/81.1 T |
| 4,716,607 | 1/1988 | Johansson | 5/81.1 T |
| 5,155,874 | 10/1992 | Kershaw | 5/81.1 |
| 5,165,122 | 11/1992 | Phalen | 5/81.1 T |
| 5,271,110 | 12/1993 | Newman | 5/81.1 |
| 5,297,834 | 3/1994 | Vanarnem | 294/140 |

*Primary Examiner*—Alexander Grosz
*Attorney, Agent, or Firm*—Richard L. Miller, P.E.

[57] ABSTRACT

A device for moving a disabled person that utilizes the substantially rectangular-shaped canvas lift sling of the Hoyer lift for safely transferring an individual a limited distance. The device for moving a disabled person includes two pair of hand grips. Each of the two pair of hand grips is removably hookable in each of the pair of spaced apart lift apertures of each of the pair of longitudinal edges of the substantially rectangular-shaped canvas lift sling of the Hoyer lift.

18 Claims, 1 Drawing Sheet

FIG. 1
(PRIOR ART)
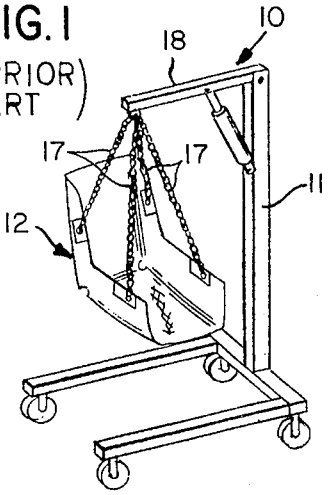
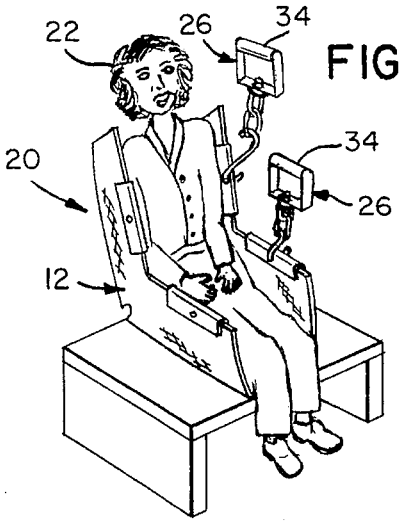
FIG. 8
FIG. 7
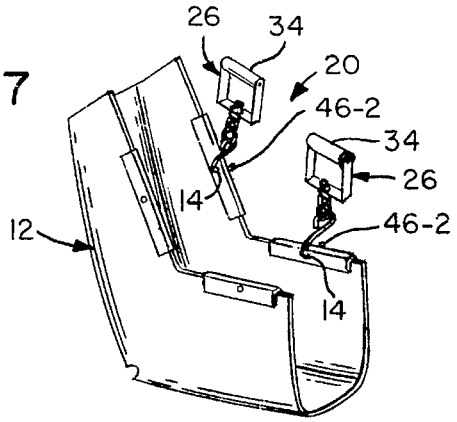
FIG. 3
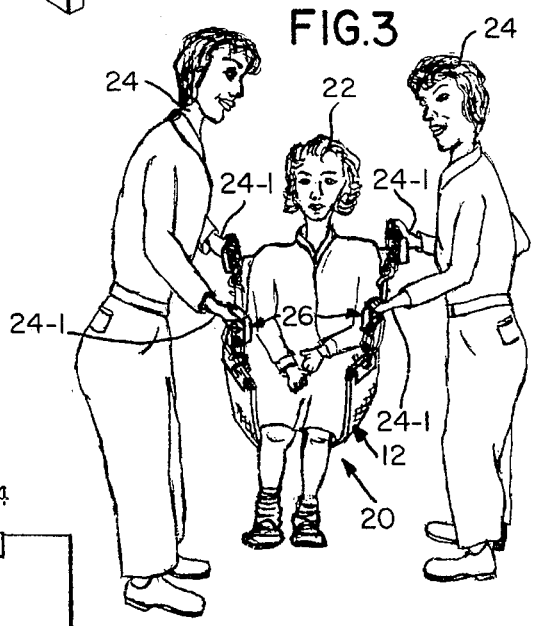
FIG. 2
(PRIOR ART)
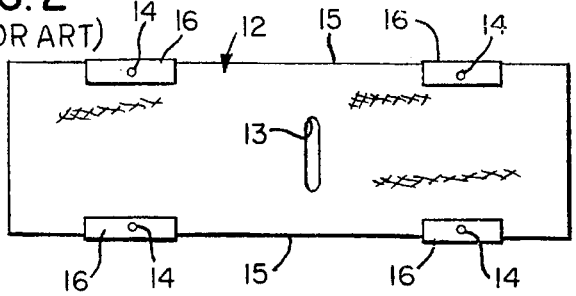
FIG. 5
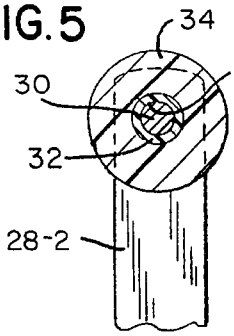
FIG. 6
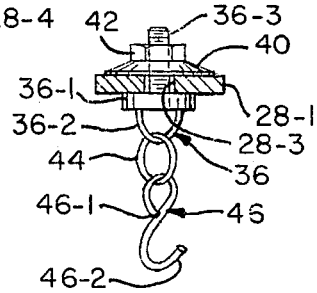
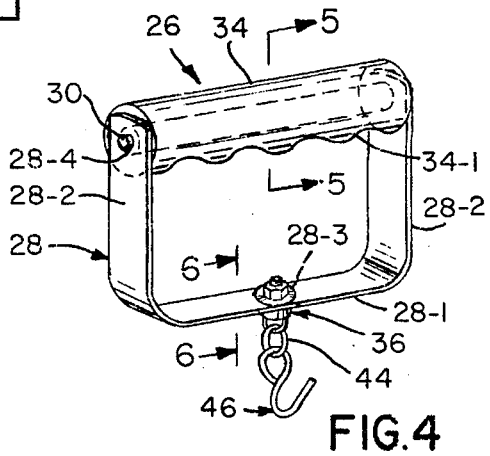
FIG. 4

DEVICE FOR MOVING A DISABLED PERSON

BACKGROUND OF THE INVENTION

The present invention relates to a device for moving a disabled person. More particularly, the present invention relates to a device for moving a disabled person that includes individual hooking units which are removably hooked into existing openings of a conventional patient lift sling.

People who are physically disabled may find it difficult if not impossible to adequately lift, move or transfer themselves to and from a wheelchair, a stationary bed, an automobile seat or the like under their own power.

Numerous innovations for moving a disabled person have been provided in the prior art that will be described. However, even though these innovations may be suitable for the specific individual purposes to which they address, they differ from the present invention in that they do not teach individual hooking units which are removably hooked into existing openings of a conventional patient lift sling.

For example, U.S. Pat. No. 2,835,902 to Fash teaches a lifting sheet that includes a multiplicity of openings arranged in pairs and spaced from each other, permitting the insertion of the arm in a sleeve-like form within the sheet with the hand free to grip a grip strap while the weight of the patient to be lifted is disposed upon the arm.

Another example, U.S. Pat. No. 4,716,607 to Johansson teaches a patient transfer mat that includes a center section and a pair of wing sections integrally and hingedly attached thereto and adapted to be placed under the patient. Grasping openings are disposed in each end with slots adjacent thereto for securing a strap therethrough.

Still another example, U.S. Pat. No. 5,165,122 to Phalen teaches a body transfer mat that includes a generally rectangular having a center support section and right and left wing portions extending from the center section. Handles are located on the underside of the sheet on each side of the central support section.

Yet another example, U.S. Pat. No. 5,297,834 to Vanarnem teaches a method and apparatus for lifting and transferring a disabled person that includes an elongated sheet of material having handles at each end.

Finally, still yet another example is a Hoyer lift which is a common type of device for moving a disabled person.

The configuration of the Hoyer lift 10 can best be seen in FIGS. 1 and 2, and as such, will be discussed with reference thereto.

The Hoyer lift 10 includes a substantially rectangular-shaped canvas lift sling 12 with an optional centrally disposed laterally oriented slot 13. A pair of spaced apart lift apertures 14 are disposed on each lift sling longitudinal edge 15 and out board of the optional centrally disposed laterally oriented slot 13. A reinforcement plate 16 reinforces each pair of lift apertures 14.

The substantially rectangular-shaped canvas lift sling 12 is suspended from a hydraulic lift frame 11 by four lift chains 17. Each of the four lift chains 17 extend downward from a common point on a hydraulic lift frame upper portion 18 and terminate in a respective one of each of the pair of lift apertures 14.

It is apparent that numerous innovations for moving a disabled person have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a device for moving a disabled person that avoids the disadvantages of the prior art.

Another object of the present invention is to provide a device for moving a disabled person that is simple and inexpensive to manufacture.

Still another object of the present invention is to provide a device for moving a disabled person that is simple to use.

Yet another object of the present invention is to provide a device for moving a disabled person that utilizes the substantially rectangular-shaped canvas lift sling of the Hoyer lift for safely transferring an individual a limited distance.

Still yet another object of the present invention is to provide a device for moving a disabled person that allows two people to safely transfer an individual to and from a bed, to and from a stretcher, to and from a wheelchair, to and from a recliner, to and from a doctor's examination table, to and from a dental chair, to and from a theater seat, and to and from a commode.

Yet still another object of the present invention is to provide a device for moving a disabled person that allows for the adjustment of the seat or bed position of the individual.

Still yet another object of the present invention is to provide a device for moving a disabled person that is used in case of emergency, such as, fire or falling of the individual.

Yet still another object of the present invention is to provide a device for moving a disabled person that provides greater freedom for the individual, such as, vacation travel and family overnight visits when a Hoyer lift cannot travel with the individual.

Still yet another object of the present invention is to provide a device for moving a disabled person that allows for transfer of the individual up or down a small set of chairs that would be impossible with the sole use of a wheelchair.

Yet still another object of the present invention is to provide a device for moving a disabled person that decreases discomfort, trauma, and pain when used on an elderly, weak, debilitated, or dying individual.

Briefly stated, still yet another object of the present invention is to provide a device for moving a disabled person that includes two pair of hand grips.

Yet still another object of the present invention is to provide a device for moving a disabled person wherein each of the two pair of hand grips is removably hookable in each of the pair of spaced apart lift apertures of each of the pair of longitudinal edges of the substantially rectangular-shaped canvas lift sling of the Hoyer lift.

Still yet another object of the present invention is to provide a device for moving a disabled person wherein each of the two pair of hand grips includes a "U"-shaped handle that has a base portion and an upright portion that extends upwardly from each end of the base portion.

Yet still another object of the present invention is to provide a device for moving a disabled person wherein the base portion of the "U"-shaped handle has a centrally disposed lift aperture and each upright portion of the "U"-shaped handle has a handle aperture disposed at its free end.

Still yet another object of the present invention is to provide a device for moving a disabled person wherein the "U"-shaped handle is one piece stainless steel.

Yet still another object of the present invention is to provide a device for moving a disabled person wherein each of the two pair of hand grips further includes a rod that passes through each handle aperture of each upright portion of the "U"-shaped handle and is attached to at least one upright portion of the "U"-shaped handle.

Still yet another object of the present invention is to provide a device for moving a disabled person wherein the rod is stainless steel.

Yet still another object of the present invention is to provide a device for moving a disabled person wherein each of the two pair of hand grips further includes a rubber tubing that fits snugly over and receives the stainless steel rod.

Still yet another object of the present invention is to provide a device for moving a disabled person wherein each of the two pair of hand grips further includes a tubular-shaped handle that is secured about the rubber tubing.

Yet still another object of the present invention is to provide a device for moving a disabled person wherein the tubular-shaped handle has finger grips to ensure positive hold.

Still yet another object of the present invention is to provide a device for moving a disabled person wherein the tubular-shaped handle is high-impact molded plastic.

Yet still another object of the present invention is to provide a device for moving a disabled person wherein each of the two pair of hand grips further includes a joint member that includes a disc-shaped base portion with a loop portion disposed on a side thereof and a threaded shaft disposed on an opposing side thereof.

Still yet another object of the present invention is to provide a device for moving a disabled person wherein the joint member is stainless steel.

Yet still another object of the present invention is to provide a device for moving a disabled person wherein the threaded shaft passes upwardly through the centrally disposed lift aperture of the base portion of the "U"-shaped handle and is secured thereto by an upwardly tapering washer and a nut.

Still yet another object of the present invention is to provide a device for moving a disabled person wherein each of the two pair of hand grips further includes a closed chain link that passes freely through said loop portion of said joint member and is pivotable thereto.

Yet still another object of the present invention is to provide a device for moving a disabled person wherein the closed chain link is stainless steel.

Still yet another object of the present invention is to provide a device for moving a disabled person wherein each of the two pair of hand grips further includes a "S"-shaped hook that has a hook upper closed loop and a hook lower open loop.

Yet still another object of the present invention is to provide a device for moving a disabled person wherein the hook upper closed loop of the "S"-shaped hook passes freely through the closed chain link and closes upon itself and is pivotable to the closed chain link.

Still yet another object of the present invention is to provide a device for moving a disabled person wherein the hook lower open loop of the "S"-shaped hook is removably hookable in each of the pair of spaced apart lift apertures of each of the pair of longitudinal edges of the lift sling.

Yet still another object of the present invention is to provide a device for moving a disabled person wherein the "S"-shaped hook is stainless steel.

Still yet another object of the present invention is to provide a device for moving a disabled person that further includes a substantially rectangular-shaped lift sling that has a pair of longitudinal edges.

Yet still another object of the present invention is to provide a device for moving a disabled person wherein each of the pair of longitudinal edges of the substantially rectangular-shaped lift sling has a pair of spaced apart lift apertures.

Still yet another object of the present invention is to provide a device for moving a disabled person wherein the substantially rectangular-shaped lift sling is canvas.

Yet still another object of the present invention is to provide a device for moving a disabled person wherein the substantially rectangular-shaped lift sling further has a reinforcement plate disposed at each of the pair of spaced apart lift apertures of each of the pair of longitudinal edges of the substantially rectangular-shaped lift sling.

Finally, still yet another object of the present invention is to provide a method for utilizing a device for moving a disabled person that includes the steps of hooking a hook lower open loop of a stainless steel "S"-shaped hook of each of two pair of hand grips of the device for moving a disabled person into each of a pair of spaced apart lift apertures of a substantially rectangular-shaped canvass lift sling, placing an individual in the substantially rectangular-shaped canvas lift sling, grabbing a high-impact molded plastic tubular-shaped handle of each of the two pair of hand grips by hands of two people, and moving the individual by lifting and moving the two pair of hand grips.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating a Hoyer lift for lifting a patient;

FIG. 2 is a diagrammatic plan view of the lift sling of the Hoyer lift shown in FIG. 1, spread out flat;

FIG. 3 is a diagrammatic perspective view illustrating the instant invention being utilized by two individuals to lift a patient;

FIG. 4 is a diagrammatic perspective view of a hand grip of the instant invention;

FIG. 5 is an enlarged cross sectional view taken along line 5—5 of FIG. 4;

FIG. 6 is an enlarged cross sectional view taken along line 6—6 of FIG. 4;

FIG. 7 is a diagrammatic perspective view illustrating two of the hand grips shown in FIG. 4 removably hooked to the lift sling shown in FIG. 2; and FIG. 8 is a diagrammatic perspective view illustrating a patient being made ready to be lifted utilizing the instant invention.

LIST OF REFERENCE NUMERALS UTILIZED IN THE DRAWING

Prior Art

10 Hoyer lift
11 hydraulic lift frame
12 substantially rectangular-shaped canvas lift sling
13 optional centrally disposed laterally oriented slot
14 pair of spaced apart lift apertures
15 lift sling longitudinal edge
16 reinforcement plate 16 reinforces each pair of lift apertures
17 four lift chains
18 hydraulic lift frame upper portion

Preferred Embodiment

20 device for lifting a disabled person of the present invention
22 individual
24 two people
24-1 hands
26 two pair of had grips
28 integrally formed stainless steel "U"-shaped handle
28-1 base portion
28-2 upright portion
28-3 centrally disposed lift aperture
28-4 handle aperture
30 stainless steel rod
32 rubber tubing
34 high-impact molded plastic tubular-shaped handle
34-1 finger grips
36 stainless steel joint member
36-1 disc-shaped base portion
36-2 loop portion
36-3 threaded shaft
40 upwardly tapering washer
42 nut
44 stainless steel closed chain link
44 stainless steel "S"-shaped hook
46-1 hook upper closed loop
46-2 hook lower open loop

DETAILED DESCRIPTION OF THE PREFERRED EMBODIMENT

Referring know to the figures in which like numerals indicate like parts, and particularly to FIG. 3, the device for lifting a disabled person of the present invention is shown generally at 20 lifting an individual 22 by two people 24.

The individual 22 is positioned in the substantially rectangular-shaped canvas lift sling 12 of the Hoyer lift 10 to which two pair of hand grips 26 are removably hooked and which are grabbed by the hands 24-1 of the two people 24.

The configuration of each of the two pair of hand grips 26 can best be seen in FIGS. 4–6, and as such, will be discussed with reference thereto.

Each of the two pair of hand grips 24 includes an integrally formed stainless steel "U"-shaped handle 28 that has a base portion 28-1 and an upright portion 28-2 that extends upwardly from each end of the base portion 28-1. The base portion 28-1 of the integrally formed stainless steel "U"-shaped handle 28 has a centrally disposed lift aperture 28-3 and each upright portion 28-2 of the integrally formed stainless steel "U"-shaped handle 28 has a handle aperture 28-4 disposed at its free end.

A stainless steel rod 30 passes through each handle aperture 28-4 of the integrally formed stainless steel "U"-shaped handle 28 and is attached to at least one upright portion 28-2 of the integrally formed stainless steel "U"-shaped handle 28.

A rubber tubing 32 fits snugly over and receives the stainless steel rod 30. The rubber tubing may extend completely form one upright portion 28-2 of the integrally formed stainless steel "U"-shaped handle 28 to the other.

A high-impact molded plastic tubular-shaped handle 34 is secured about the rubber tubing 32 and has finger grips 34-1 to ensure positive hold. The high-impact molded plastic tubular-shaped handle 34 may extend completely form one upright portion 28-2 of the integrally formed stainless steel "U"-shaped handle 28 to the other.

A stainless steel joint member 36 includes a disc-shaped base portion 36-1 with a loop portion 36-2 integrally formed to one side thereof and a threaded shaft 36-3 integrally formed to an opposing side thereof.

The threaded shaft 36-3 passes upwardly through the centrally disposed lift aperture 28-3 of the integrally formed stainless steel "U"-shaped handle 28 and is secured to the base portion 28-1 of the integrally formed stainless steel "U"-shaped handle 28 by an upwardly tapering washer 40 and a nut 42.

A stainless steel closed chain link 44 passes freely through the loop portion 36-2 of the stainless steel joint member 36 and is pivotable thereto.

A stainless steel "S"-shaped hook 46 has a hook upper closed loop 46-1 and a hook lower open loop 46-2. The hook upper closed loop 46-1 of the stainless steel "S"-shaped hook 46 passes freely through the stainless steel closed chain link 44 and closes upon itself while being pivotable to the stainless steel closed chain link 44.

The stainless steel joint member 36, the stainless steel closed steel chain link 44, and the stainless steel "S"-shaped hook 46 together form a swivel joint.

As best seen in FIG. 4, each hand grip is generally rectangular in shape, with an upper portion gripable by a hand of an attendant, and a lower portion of each said hand grip including a swivel joint having a hook portion.

The utilization of the device for moving a disabled person 20 can best be seen in FIGS. 3, 7, and 8, and as such, will be discussed with reference thereto.

As shown in FIG. 7, the hook lower open loop 46-2 of the stainless steel "S"-shaped hook 46 of each of the two pair of hand grips 26 is hooked into each of the pair of spaced apart lift apertures 14 of the substantially rectangular-shaped canvas lift sling 12 of the Hoyer lift 10.

As shown in FIG. 8, the individual 22 is placed in the substantially rectangular-shaped canvas lift sling 12 of the Hoyer lift 10.

As shown in FIG. 3, the high-impact molded plastic tubular-shaped handle 34 of each of the two pair of hand grips 26 is grabbed by the hands 24-1 of the two people 24 and lifted.

After successful transfer of the individual 22, the hand grips 26 are removed from the substantially rectangular-shaped canvas lift sling 12 of the Hoyer lift 10 and stored for next use.

It will be understood that each of the elements described above, or two or more together, may also find a useful application in other types of constructions differing from the types described above.

While the invention has been illustrated and described as embodied in a device for moving a disabled person, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disabled person lifting device comprising substantially rectangular-shaped lift sling that has a pair of longitudinal edges, each of said pair of longitudinal edges of said substantially rectangular-shaped lift sling having a pair of spaced apart lift apertures and two pair of hand grips, each of said two pair of hand grips being removably hookable in each of said pair of spaced apart lift apertures of each of said pair of longitudinal edges of said lift sling, each of said hand grips having a generally rectangular shape, with an upper portion thereof grippable by a hand of an attendant, and a lower portion of each of said hand grip including a swivel joint having a hook portion.

2. The device as defined in claim 1, wherein said each of said two pair of hand grips includes a "U"-shaped handle that has a base portion and an upright portion that extends upwardly from each end of said base portion, said base portion of said "U"-shaped handle has a centrally disposed lift aperture and each said upright portion of said "U"-shaped handle has a handle aperture disposed at its free end.

3. The device as defined in claim 2, wherein said "U"-shaped handle is one piece stainless steel.

4. The device as defined in claim 2, wherein said each of said two pair of hand grips further includes a rod that passes through each said handle aperture of said each said upright portion of said "U"-shaped handle and is attached to at least one said each said upright portion of said "U"-shaped handle.

5. The device as defined in claim 4, wherein said rod is stainless steel.

6. The device as defined in claim 4, wherein said each of said two pair of hand grips further includes a rubber tubing that fits snugly over and receives said stainless steel rod.

7. The device as defined in claim 6, wherein said each of said two pair of hand grips further includes a tubular-shaped handle that is secured about said rubber tubing.

8. The device as defined in claim 7, wherein said tubular-shaped handle has finger grips to ensure positive hold.

9. The device as defined in claim 7, wherein said tubular-shaped handle is high-impact molded plastic.

10. The device as defined in claim 7, wherein said each of said two pair of hand grips further includes a joint member that includes a disc-shaped base portion with a loop portion disposed on a side thereof and a threaded shaft disposed on an opposing side thereof.

11. The device as defined in claim 10, wherein said joint member is stainless steel.

12. The device as defined in claim 10, wherein said threaded shaft passes upwardly through said centrally disposed lift aperture of said base portion of said "U"-shaped handle and is secured thereto by an upwardly tapering washer and a nut.

13. The device as defined in claim 10, wherein said each of said two pair of hand grips further includes a closed chain link that passes freely through said loop portion of said joint member and is pivotable thereto.

14. The device as defined in claim 13, wherein said closed chain link is stainless steel.

15. The device as defined in claim 13, wherein said each of said two pair of hand grips further includes a "S"-shaped hook that has a hook upper closed loop and a hook lower open loop, said hook upper closed loop of said "S"-shaped hook passes freely through said closed chain link and closes upon itself and is pivotable to said closed chain link, said hook lower open loop of said "S"-shaped hook is removably hookable in said each of said pair of spaced apart lift apertures of said each of a pair of longitudinal edges of said lift sling.

16. The device as defined in claim 15, wherein said "S"-shaped hook is stainless steel.

17. The device as defined in claim 1, wherein said substantially rectangular-shaped lift sling is canvas.

18. The device as defined in claim 1, wherein said substantially rectangular-shaped lift sling further has a reinforcement plate disposed at said each of said pair of spaced apart lift apertures of said each of said pair of longitudinal edges of said substantially rectangular-shaped lift sling.

* * * * *